US005092003A

United States Patent [19]

Weinberg

[11] Patent Number: 5,092,003

[45] Date of Patent: Mar. 3, 1992

[54] WATER CONSERVATION DEVICE

[76] Inventor: Louis Weinberg, 1705 Biarritz Dr., Miami Beach, Fla. 33141

[21] Appl. No.: 484,995

[22] Filed: Feb. 26, 1990

[51] Int. Cl.[5] ..... E03C 1/14; E03C 1/182

[52] U.S. Cl. ..... 4/653; 4/287; 4/665; 4/191; 137/873; 137/876

[58] Field of Search ..... 4/191, 286, 287, 292, 4/288, 661, 654, 204, 653, 665; 138/37; 137/872, 873, 874, 876

[56] References Cited

U.S. PATENT DOCUMENTS 1,109,946 9/1914 Stack ..... 138/37 X
2,297,060 9/1942 Henry ..... 4/287
2,573,663 10/1951 Hand ..... 138/37
3,086,748 4/1963 Reinemann ..... 4/191 X
3,353,558 11/1967 Hobolth ..... 137/873 X
3,990,474 11/1976 Harms ..... 137/873
4,162,218 7/1979 McCormick ..... 4/665
4,218,786 8/1980 Toglarino ..... 4/661
4,555,820 12/1985 Dragstream ..... 4/191
4,882,789 11/1989 Kraverath ..... 4/191

*Primary Examiner*—Henry K. Artis

[57] ABSTRACT

A water conservation device composed of a cup movable relative to an opening for selectively diverting water flow from a main drain pipe to a side tap to conduct water to be conserved to a remote location through a drain pipe.

6 Claims, 1 Drawing Sheet

WATER CONSERVATION DEVICE

FIELD OF THE INVENTION

This invention relates to water conservation devices and more particularly, to a water conservation device which is adapted to be installed in the sink of homes.

BACKGROUND OF THE INVENTION

In many places, there is a shortage of water from time to time. This invention is of a device which is adapted to be installed in a conventional kitchen sink in the drain pipe which is adapted to be selectively utilized for draining water which would otherwise be wasted; to a garden, for example, through a secondary drain pipe.

The invention is composed of a drain pipe which is attached to the outflow from a kitchen sink and which pipe includes a side opening and within the pipe means for selectively opening and closing the drain pipe to divert water when desired to a secondary outflow through the side wall of the drain pipe.

It is an object of this invention, therefore, to provide a device which is adapted to be installed as a kitchen sink drain pipe which may be utilized when desired to divert water which would otherwise be wasted, to a garden, for example, through an outflow conduit but which can be closed when desired so that the water flowing from the sink will flow through the main drain pipe.

In accordance with these and other objects, this invention will now be described with reference to the following drawings in which:

FIG. 1 is an exploded perspective view of the invention.

DETAILED DESCRIPTION OF THE PREFERRED EMBODIMENT

Figure 1:
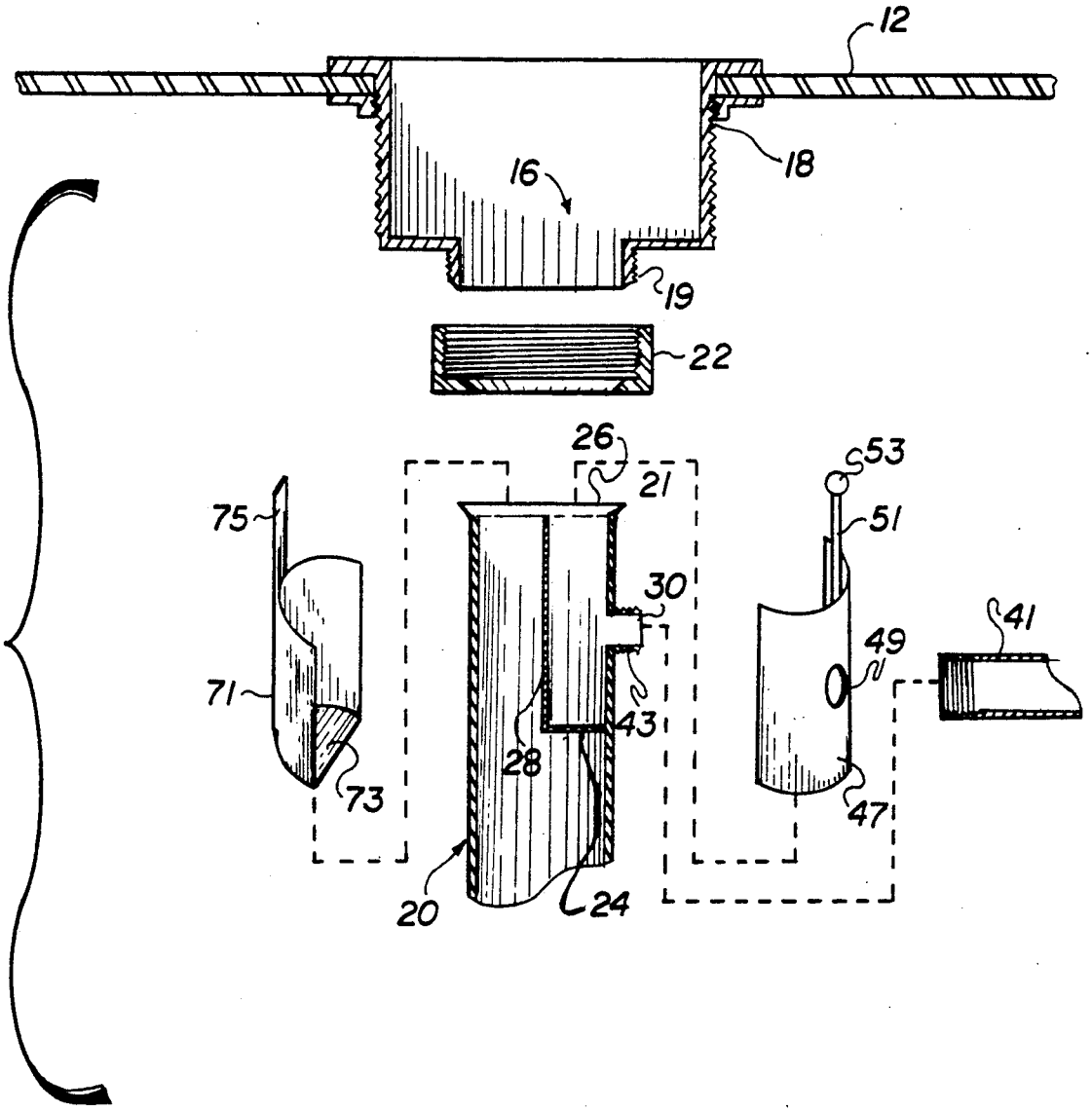

In the floor 12 of a convention sink for washing dishes and the like, there is usually a central opening 16. This receives a flanged tube 18 which is provided with a lower, exteriorly threaded portion 19 to connect a drain pipe 20 which is flanged as at 21 at its upper end adapting it to be captivated by a keeper ring 22 threadably connected to the threaded portion 19. The drain pipe of the present invention is provided with a partial floor 24 about six inches below the open end 26 and a septum 28 extending from the partial floor to the open upper end to define a chamber within the drain pipe. The drain also has a side opening 30 communicating with said chamber between the open upper end 26 and the partial floor 24. Thus, a component of the water entering the drain tube will normally exit the opening 30 and may be used to water a garden, for example, when conducted away by a pipe 41 threadably connected, for example, to the nipple 43. Within the chamber formed by the partial floor and septum, there are provided means to close the opening 30 or, when desired, open it. This means may be in the form of a semi-cylindrical member 47 slidably received in the drain pipe and provided with an opening 49 spaced from the end 51 so that, when in the lower most position, the opening 49 registers with the opening 30 but, however, when lifted by the operator means 51 using the knob 53 accessible through the sink opening, for example, the opening 30 is closed by the portion below the opening 49 in the member 47. Thus, a component of water flow may be diverted to the garden, for example, through the pipe 41 when desired. Also, there may be provided a semi-cylindrical member 71 slidably received in the drain pipe opposite said chamber and having an axial length longer than that of the member 47 with a partial floor 73 using, the member 71 the operator 75 which is accessible though the sink opening can be raised or lowered to open or close the water flow through the drain pipe. Thus, when the opening 30 is closed, the water can be caused to flow down the main drain pipe by lowering member 71 and when the opening 30 is open, the water can be diverted through opening 30 by raising the member 71.

While the instant invention has been shown and described in what is considered a practical and preferred embodiment, it is recognized that departures may be made within the spirit and scope of this invention which is therefore not to be limited except as set forth in the claims which follow.

What is claimed is:

1. A water conservation device for use with a sink having a floor with a drain opening therein and an exteriorly threaded annular portion extending therethrough comprising:

a water drain pipe having an open upper end and an open lower end to constitute an open entrance mouth and an open primary exit port, respectively, and a generally radially facing secondary exit port positioned between the entrance mouth and the exit port;

means for connecting the entrance mouth to said exteriorly threaded annular portion for fluid communication therewith;

a liquid impervious septum mounted in said drain pipe and having a first portion with an upstream end and a downstream end spanning the drain pipe and confronting the secondary exit port, said septum first portion extending axially from the upstream end located adjacent the mouth to the downstream end located beyond the secondary exit port and including a second portion extending between the downstream end and the drain pipe, said first and second portions together with said drain pipe constraining flow in the drain pipe to a first flow component from the mouth to the primary exit port and a second flow component from the mouth to the secondary exit port; and means to selectively open and close the secondary exit port including first operator means exteriorly accessible on the water drain pipe.

2. The water conservation device as set forth in claim 1 including means to selectively open and close the flow of water through the first flow component and including second operator means exteriorly accessible on the drain pipe.

3. The water conservation device as set forth in claim 2 wherein said means to selectively open and close the secondary exit port comprises a member in the drain pipe movable between a first position blocking flow through the secondary exit port and a second position wherein the secondary exit port is open.

4. The water conservation device as set forth in claim 1 wherein the septum generally extends diametrically in spanning relation of the drain pipe and said means is a generally semi-cylindrical member disposed in overlying relationship to the secondary exit port and provided with an opening movable between said first and second positions, said opening being in registry with said secondary exit port when in the second position.

5. The water conservation device as set forth in claim 2 wherein the means to open and close the first flow component comprises a floor in the drain pipe mounted for axial movement toward and away from the downstream end of the septum.

6. The water conservation device as set forth in claim 2 wherein the first and second operator means include an operator adjacent the drain pipe mouth and extending axially therefrom.

* * * * *